US010969204B2

(12) United States Patent
Sivley et al.

(10) Patent No.: US 10,969,204 B2
(45) Date of Patent: Apr. 6, 2021

(54) SYSTEMS AND METHODS FOR PENETRATING STRUCTURES WITH REPOSITIONABLE SHAPED CHARGES

(71) Applicant: The United States of America, as represented by the Secretary of the Navy, Crane, IN (US)

(72) Inventors: Theodore E. Sivley, Richardson, TX (US); Joshua W. McIntosh, Bloomfield, IN (US); Kevin Stewart, Camron, NC (US); Eric Scheid, Bloomington, IN (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 16/245,619

(22) Filed: Jan. 11, 2019

(65) Prior Publication Data

US 2019/0212110 A1 Jul. 11, 2019

Related U.S. Application Data

(60) Provisional application No. 62/616,392, filed on Jan. 11, 2018.

(51) Int. Cl.
*F42B 1/028* (2006.01)
*F42B 3/00* (2006.01)

(52) U.S. Cl.
CPC ..... *F42B 1/028* (2013.01); *F42B 3/00* (2013.01)

(58) Field of Classification Search
CPC ..... F42B 1/02; F42B 1/028; F42B 3/02
See application file for complete search history.

(56) References Cited

U.S. PATENT DOCUMENTS 2,605,704 A * 8/1952 Dumas ..... F42B 1/02 102/307
3,117,518 A * 1/1964 Porter ..... F42B 3/08 102/307
3,348,482 A * 10/1967 Keener ..... E21C 45/00 102/310
3,489,086 A * 1/1970 Kintish ..... F42B 4/26 102/334
4,510,870 A * 4/1985 Walters ..... F42B 1/028 102/307
4,982,667 A 1/1991 Weimann
5,377,594 A * 1/1995 Alford ..... B21D 28/00 102/308

(Continued)

FOREIGN PATENT DOCUMENTS

GB 2522413 A * 7/2015 ..... F42B 1/024

*Primary Examiner* — Gabriel J. Klein
(74) *Attorney, Agent, or Firm* — Naval Surface Warfare Center, Crane Division; Eric VanWiltenburg

(57) ABSTRACT

The present invention relates to using at least one explosive device to enable rapid and accurate positioning and repositioning of at least one explosive charge for controlled penetration of targets. A penetrator allows effective demolition with minimal explosive load. An attachment collar with magnetic inserts allows quick repositioning of explosive devices. A plurality of explosive devices allows a demolition profile to be rapidly created and adjusted on-site to adapt to changes in structural or environmental conditions.

12 Claims, 9 Drawing Sheets

(56) References Cited

U.S. PATENT DOCUMENTS

| | | | | |
|---|---|---|---|---|
| 6,606,950 | B1 * | 8/2003 | Putman | F41H 11/12 102/306 |
| 6,766,744 | B1 * | 7/2004 | Song | F42B 1/02 102/311 |
| 7,210,409 | B2 * | 5/2007 | Johnson | F42B 3/02 102/317 |
| 7,472,652 | B1 | 1/2009 | Scheid | |
| 8,006,621 | B1 * | 8/2011 | Cherry | B26F 3/04 102/307 |
| 8,037,828 | B1 * | 10/2011 | Jakaboski | F42B 1/02 102/305 |
| 8,904,934 | B1 * | 12/2014 | Scheid | F42B 3/087 102/307 |
| 9,074,855 | B1 * | 7/2015 | Frericks | F42B 1/02 |
| 9,291,435 | B2 | 3/2016 | Scheid | |
| 9,303,961 | B1 * | 4/2016 | Frericks | F42B 1/028 |
| 9,441,924 | B1 * | 9/2016 | Frericks | F42B 1/032 |
| 9,482,499 | B1 | 11/2016 | Gotzmer | |
| 2002/0078850 | A1 * | 6/2002 | Renfro | F42B 1/028 102/476 |
| 2005/0126420 | A1 * | 6/2005 | Givens | F42B 3/02 102/310 |
| 2007/0101855 | A1 * | 5/2007 | Metcalfe | F42B 3/08 89/1.14 |
| 2010/0308198 | A1 * | 12/2010 | Bevirt | F16M 11/40 248/440.1 |
| 2012/0192748 | A1 | 8/2012 | Scheid | |
| 2016/0130902 | A1 * | 5/2016 | Wright | F42C 11/00 89/1.15 |
| 2017/0052010 | A1 * | 2/2017 | Scheid | F42B 12/105 |
| 2017/0184379 | A1 * | 6/2017 | Barzilai | F42B 4/20 |
| 2018/0259306 | A1 * | 9/2018 | Trefilov | E21B 43/117 |

* cited by examiner

SYSTEMS AND METHODS FOR PENETRATING STRUCTURES WITH REPOSITIONABLE SHAPED CHARGES

CROSS-REFERENCE TO RELATED APPLICATIONS

This patent application claims the benefit of U.S. Provisional Application No. 62/616,392, titled SYSTEMS AND METHODS FOR PENETRATING STRUCTURES WITH REPOSITIONABLE SHAPED CHARGES, filed Jan. 11, 2018, the disclosure of which is expressly incorporated by reference herein.

STATEMENT REGARDING FEDERALLY SPONSORED RESEARCH OR DEVELOPMENT

The invention described herein includes contributions by one or more employees of the Department of the Navy made in performance of official duties and may be manufactured, used and licensed by or for the United States Government for any governmental purpose without payment of any royalties thereon. This invention (Navy Case 200,493) is assigned to the United States Government and is available for licensing for commercial purposes. Licensing and technical inquiries may be directed to the Technology Transfer Office, Naval Surface Warfare Center Crane, email: Cran_CTO@navy.mil.

FIELD OF THE INVENTION

The present invention relates to using at least one explosive device to enable rapid and accurate positioning and repositioning of at least one explosive charge for controlled penetration of targets.

BACKGROUND AND SUMMARY OF THE INVENTION

Linear shaped charges are limited in the scope (e.g., thickness) of targets that can be engaged. They also often require significant pre-existing knowledge of target geometry to use effectively. Targets that are thick and/or irregular composites of materials traditionally require significant amounts of explosive to overcome or cannot be effectively addressed by current forms of hand-held explosive devices.

The purpose of this invention is to enable controlled and properly-positioned explosive penetration of composite targets with shaped charges and explosively formed penetrators and allow for rapid and accurate placement/repositioning of one or more charges on a target. The charges allow economical, reliable, and precise explosive engagement with minimal explosive weight, collateral damage and time on target. Rather than bulk-blasting of target with large amounts of explosives, this invention allows an operator to penetrate a target in particularly vulnerable (e.g., load bearing) locations by housing the explosive in a device that may be physically attached to the target at the optimal position. The device may also be unattached and repositioned with ease. This allows for precision demolition of the target with reduced explosive, time and collateral damage.

According to an illustrative embodiment of the present disclosure, the invention comprises an attachment collar having a plurality of connectors attached to the bottom face of the collar. The attachment collar can have a flat contact surface on a bottom side such that the contact surface can be held flush against a target. The collar can contain a cavity allowing for the insertion and securing of a charge container, with the charge container thus forming a body cavity. The attachment collar can couple to a bottom end of a charge container such that charge container extends to the bottom side of attachment collar. Alternatively, the attachment collar can couple to a bottom end of charge container such that the attachment collar and charge container form a continuous structure. The charge container creates a body cavity containing the penetrator metal, explosive load and detonation components, including the booster explosive and wave shaper. Connected to the bottom of the attachment collar is a penetrator having a semi-spherical body with an exterior surface, an interior surface and base rim. The interior surface forms a penetrator cavity within the semi-spherical body and an aperture between the penetrator cavity and exterior of the penetrator. The penetrator cavity of the semi-spherical body faces the top face of the attachment collar. An explosive load can be placed in the body cavity formed by the charge container and on top of the penetrator. At least one wave shaper can be disposed on top of the explosive load with the explosive load also being placed around the wave shaper, beneath the wave shaper or both beneath or around the wave shaper. The wave shaper's function is to control the geometry of the detonation wave. Above the wave shaper can be a booster that assists in the initiation of the detonation. A charge top with an aperture having a cavity can be disposed above the booster. The charge top can be disposed within the confines of the charge container. An initiator holder can be disposed inside the aperture of the charge top. The penetrator can comprise any metal, including copper.

According to a further illustrative embodiment of the present disclosure, the explosive load is contained within a clear or transparent charge container. By having the charge container in which the explosives are housed be transparent, the user may view the interior of the container to confirm that the explosive charge is properly packed. Explosive loads that are not properly packed, either do to air gaps in the explosive load or any other abnormality, result in a non-optimal explosive wave on detonation. A clear charge container allows the user to assess packing prior to detonation and if necessary remove and re-pack the explosive load.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
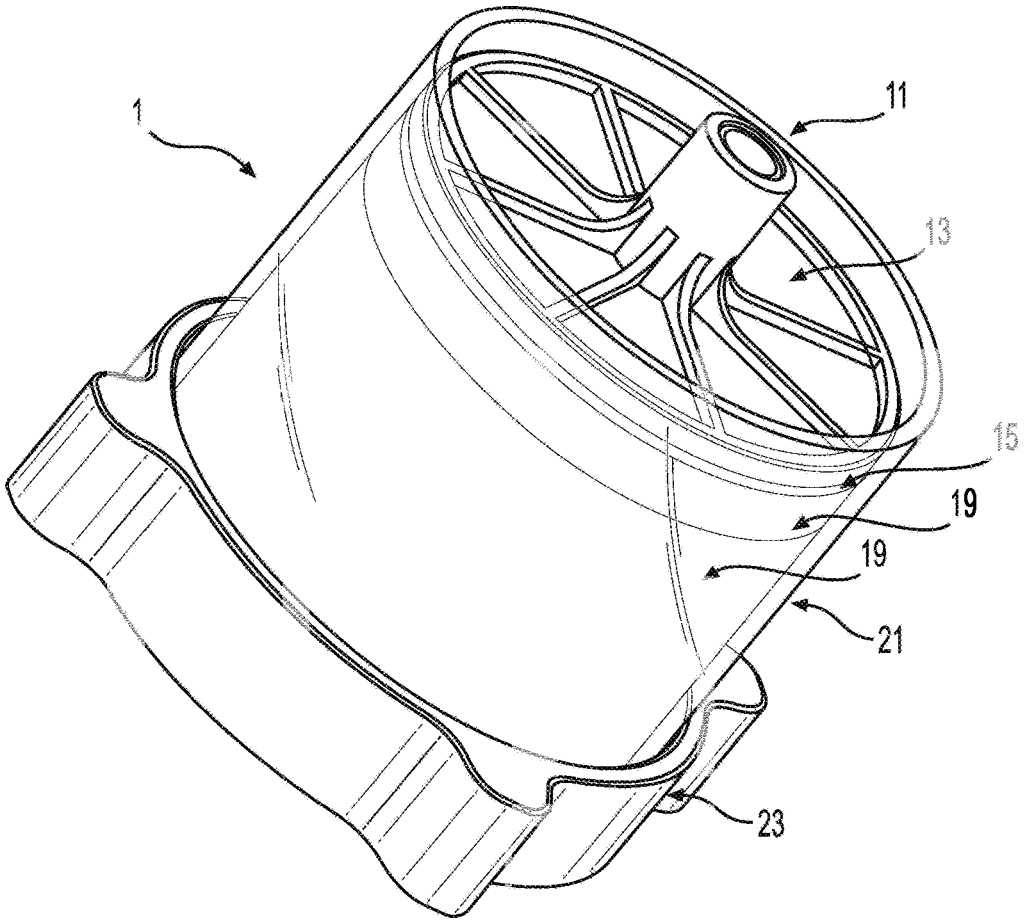
FIG. 1 shows an exterior view of an exemplary explosive device
Figure 2:
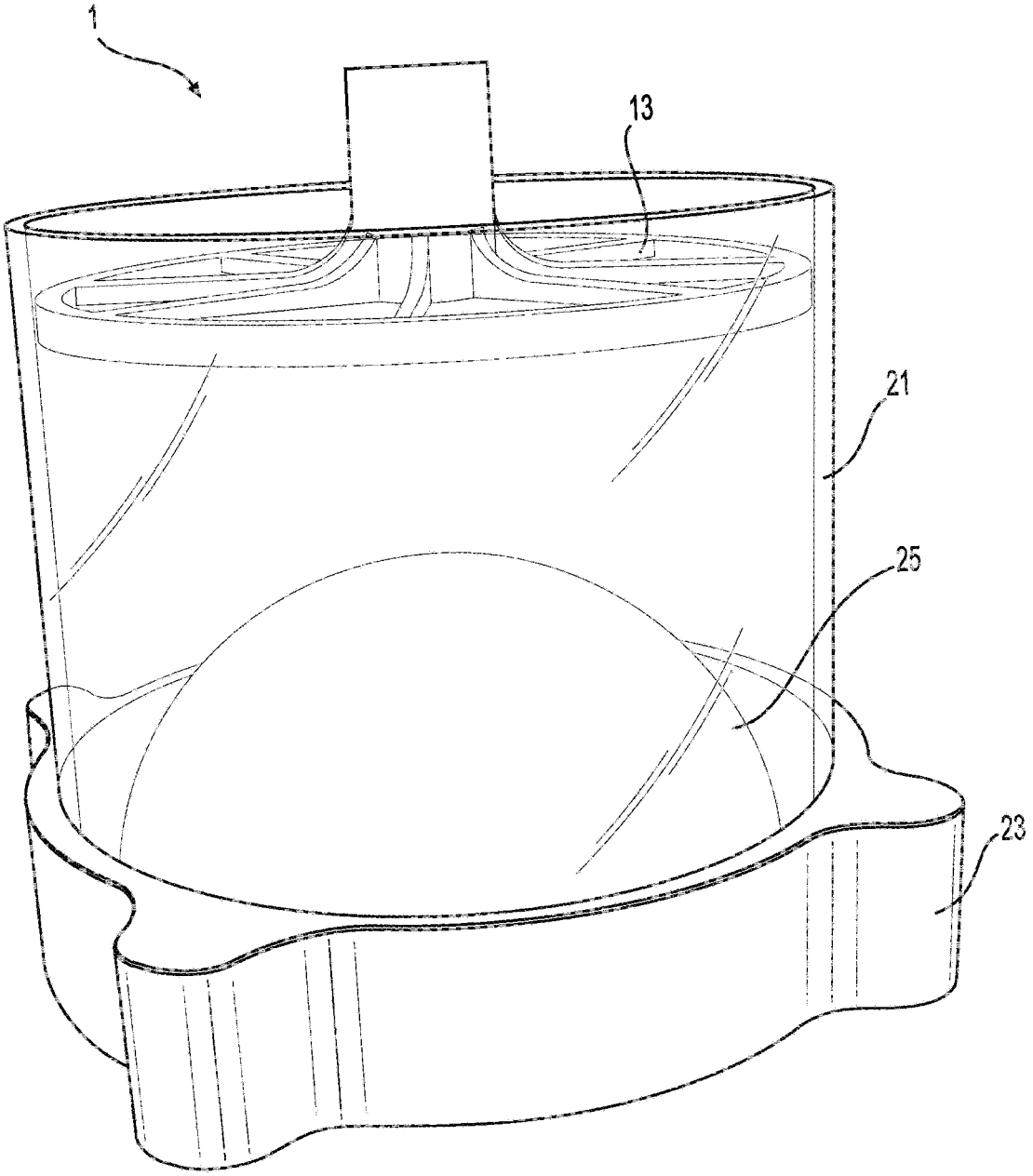
FIG. 2 shows an exterior side view of an exemplary explosive device with several internal components removed.

FIG. 1 shows an exterior view of an exemplary explosive device 1. A charge top insert 13 can be inserted into a top end of charge container 21. An initiator holder 11 can hold a detonation cord (not shown) in contact with an explosive booster 15 such that activating the detonation cord can trigger the booster to detonate. Initiator holder 11 can be integrated into the structure of charge top insert 13 or can be a separate component that is inserted into a cylindrical section of charge top insert 13. A wave shaper 17 can be placed between booster 15 and an explosive load 19 such that the detonation wave created by booster 15 can be altered. An attachment collar 23 can have a flat contact surface on a bottom side such that the contact surface can be held flush against a target. Attachment collar 23 can couple to a bottom end of charge container 21 such that charge container 21 extends to the bottom side of attachment collar 23. In some embodiments, attachment collar 23 can couple to a bottom end of charge container 21 such that attachment collar 23 and charge container 21 form a continuous structure. Explosive load 19 can be placed between booster 15 or wave shaper 17 and a penetrator (see FIG. 2). Charge container 21 can be made from a transparent material (e.g., acrylic) to allow visual inspections of the explosive load 19 for deficiencies (e.g., voids in the load) so that a defective explosive device can be rapidly replaced FIG. 2 shows an exterior side view of an exemplary explosive device 1 with several internal components removed to show a penetrator 25 in relation to components shown in FIG. 1. Penetrator 25 can be a hollow semi-spherical structure with an open bottom. Penetrator 25 can be placed within charge container 21 and attachment collar 23 such that the bottom of penetrator 25 rests on a lip of attachment collar 23. Charge top insert 13 can be firmly coupled to charge container 21 be friction. The charge top insert 13 can have negligible clearance when placed inside the charge container such that inner wall of the charge container will compress the charge top, holding it in place.

Figure 3:
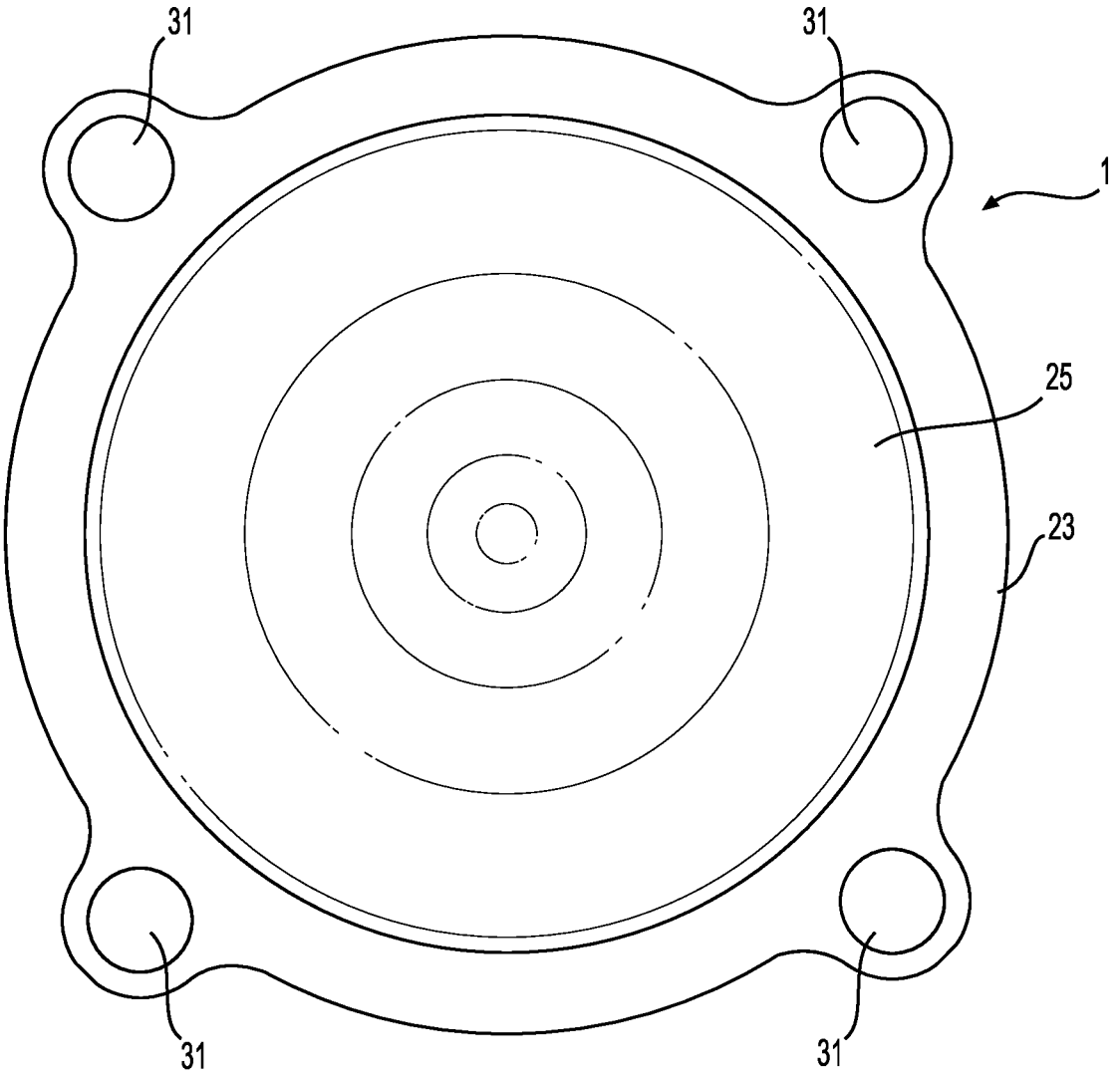
FIG. 3 shows an exterior bottom view of an exemplary explosive device having a copper EFP within an attachment collar.
Figure 9:
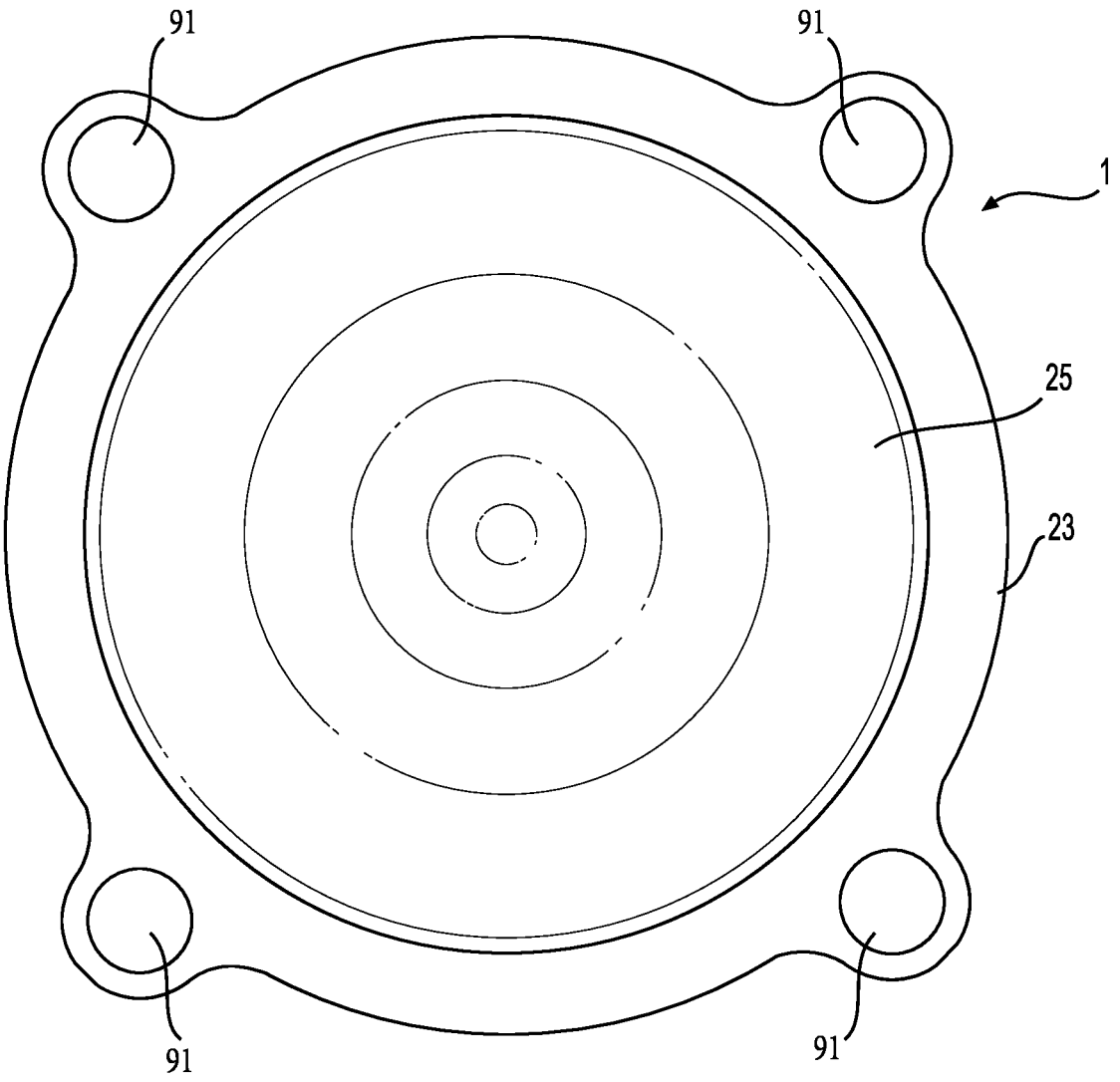
FIG. 9 shows an exterior bottom view of an exemplary explosive device.

FIG. 3 shows an exterior bottom view of an exemplary explosive device 1 having a penetrator 25 surrounded by an attachment collar 23. An inner surface of penetrator 25 is exposed through an open bottom of penetrator 25. A plurality of magnets 31 allow explosive device 1 to quickly couple to a target surface. The plurality of magnets 31 can be of a strength sufficient to hold the device in place (e.g., dependent on the weight of the explosive device). The magnets will allow the device to attach to any ferromagnetic surface for the removal and repositioning of the device. In alternative embodiments, magnets 31 can be replaced by other connectors, e.g. adhesives and mechanical couplers including straps, hooks, latches and suction cups. In an exemplary embodiment, the connectors can be connected to the attachment collar by a ball and socket joint (e.g., as shown in FIG. 9, element 91) to allow the connectors to swivel and/or rotate in the direction of a target surface to better attach to irregular (e.g., non-level) surfaces. The connectors positioned at the bottom face of the attachment collar can be detachable and interchangeable. The connectors can be mechanically coupled to a plurality of housings in the attachment collar such that different connector types can be attached to the housing, e.g. a mechanical connector can be exchanged with an adhesive connector or magnetic connector. The interchangeability of the connector can allow a user to adapt an exemplary device to different target surfaces with ease in a short amount of time, or use a combination of different connector types in a single device.

Figure 4:
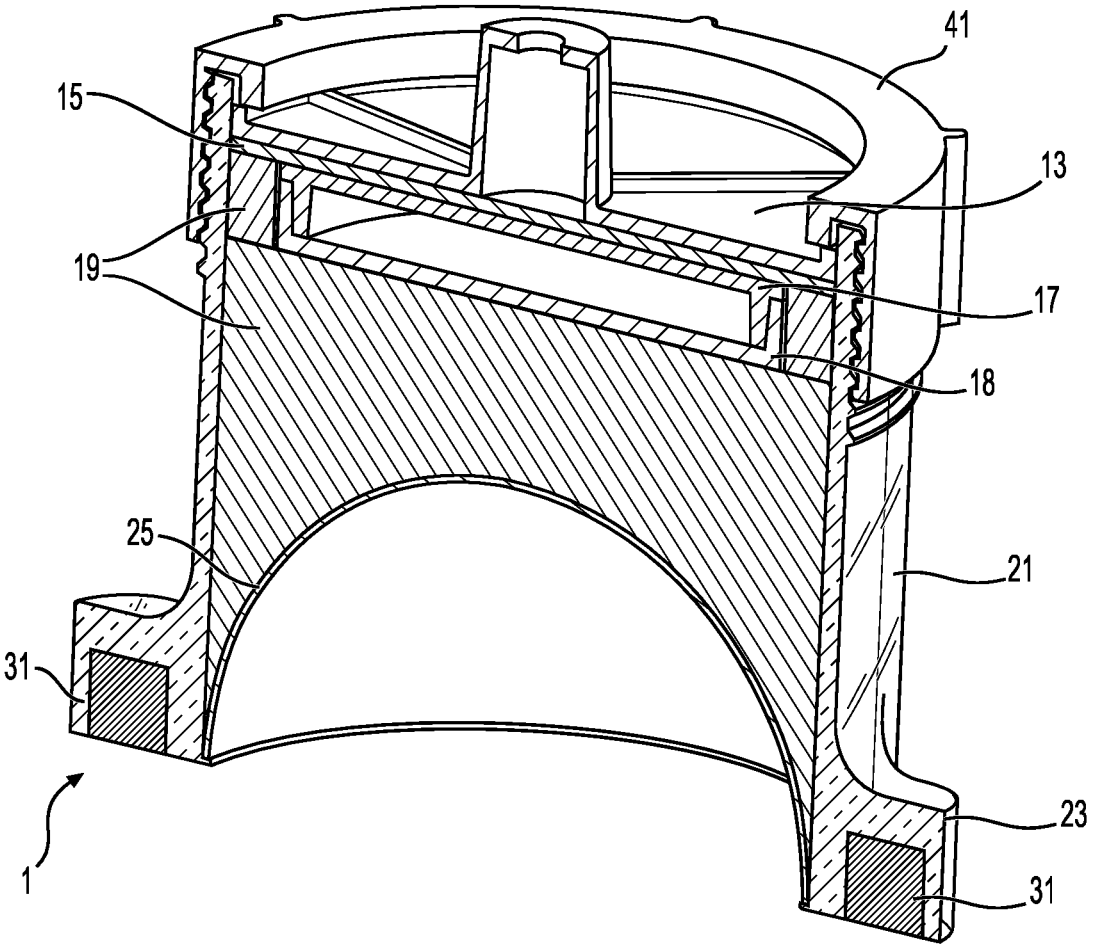
FIG. 4 shows a cross-sectional side view of an exemplary explosive device having a threaded charge container and container cap for locking a charge top insert.

FIG. 4 shows a cross-sectional side view of an exemplary explosive device 1 having a threaded charge container 21 and container cap 41 for locking a charge top insert 13. Charge top insert 13 can be placed on top of booster 15, and container cap 41 is screwed onto charge container 21 to seal charge top insert 13 in place. At least one wave shaper (e.g., first wave shaper 17 and second wave shaper 18) can be inserted between booster 15 and explosive load 19. In some embodiments, charge top insert 13 can be coupled to container cap 41 such screwing the container cap 41 to charge container 21 will position charge top insert 13 against booster 15 or waveguide 17. The magnetic force between magnets 31 and a target surface (not shown) holds attachment collar 23 and bottom rim of penetrator 25 close to the target surface.

Figure 5:
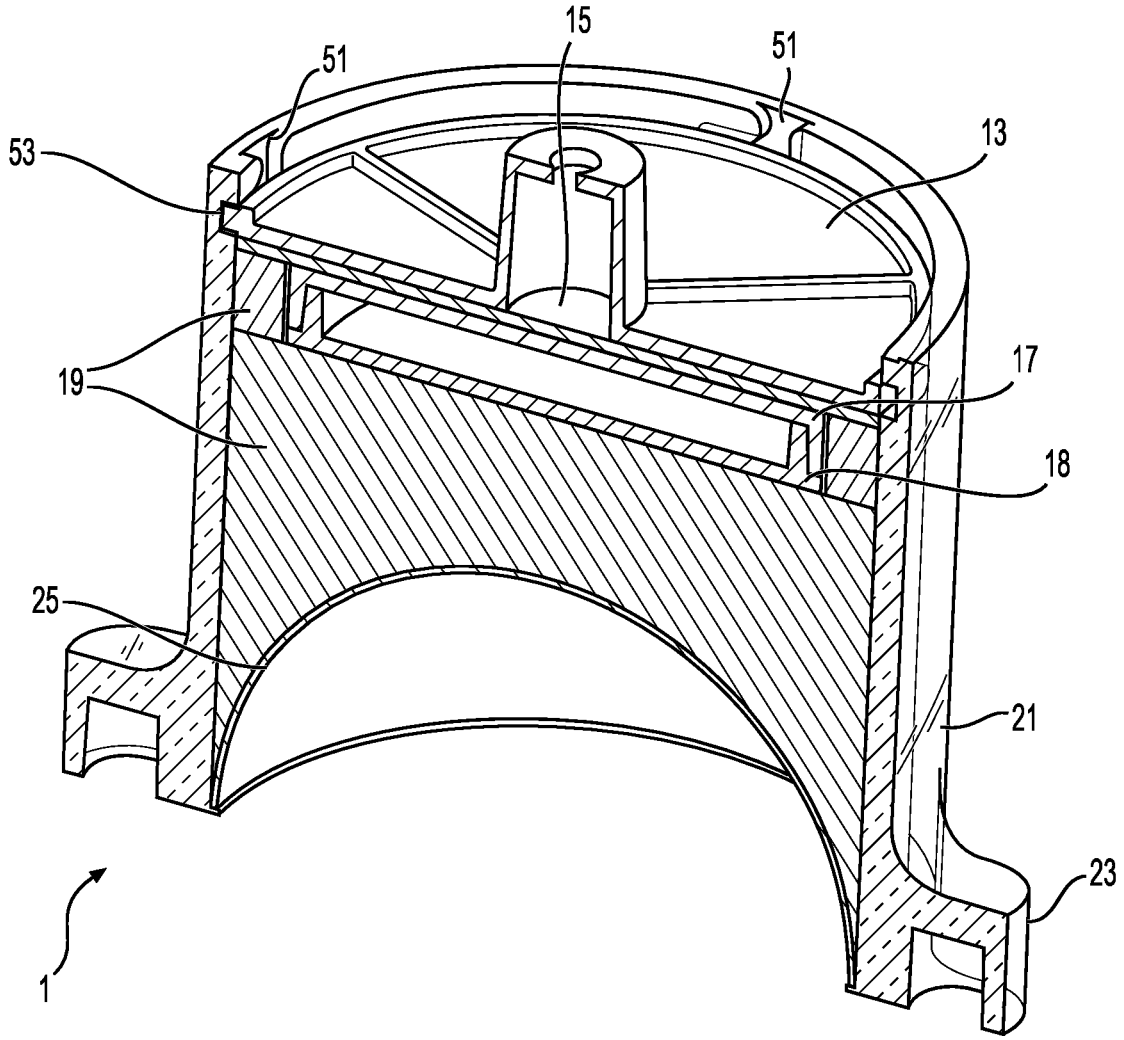
FIG. 5 shows a cross-sectional side view of an exemplary explosive device having a slide-lock track for locking a charge top insert.

FIG. 5 shows a cross-sectional side view of an exemplary explosive device 1 having a twist-lock track 53 within charge container 21 for locking a charge top insert 13. Charge top insert 13 can be inserted into charge container 21 such that charge top insert 13 passes through a plurality of lock passages 51 to enter twist-lock track 53. Once inserted charge top insert 13 can be rotated such that twist-lock track 53 prevents charge top insert 13 from being removed.

Figure 6:
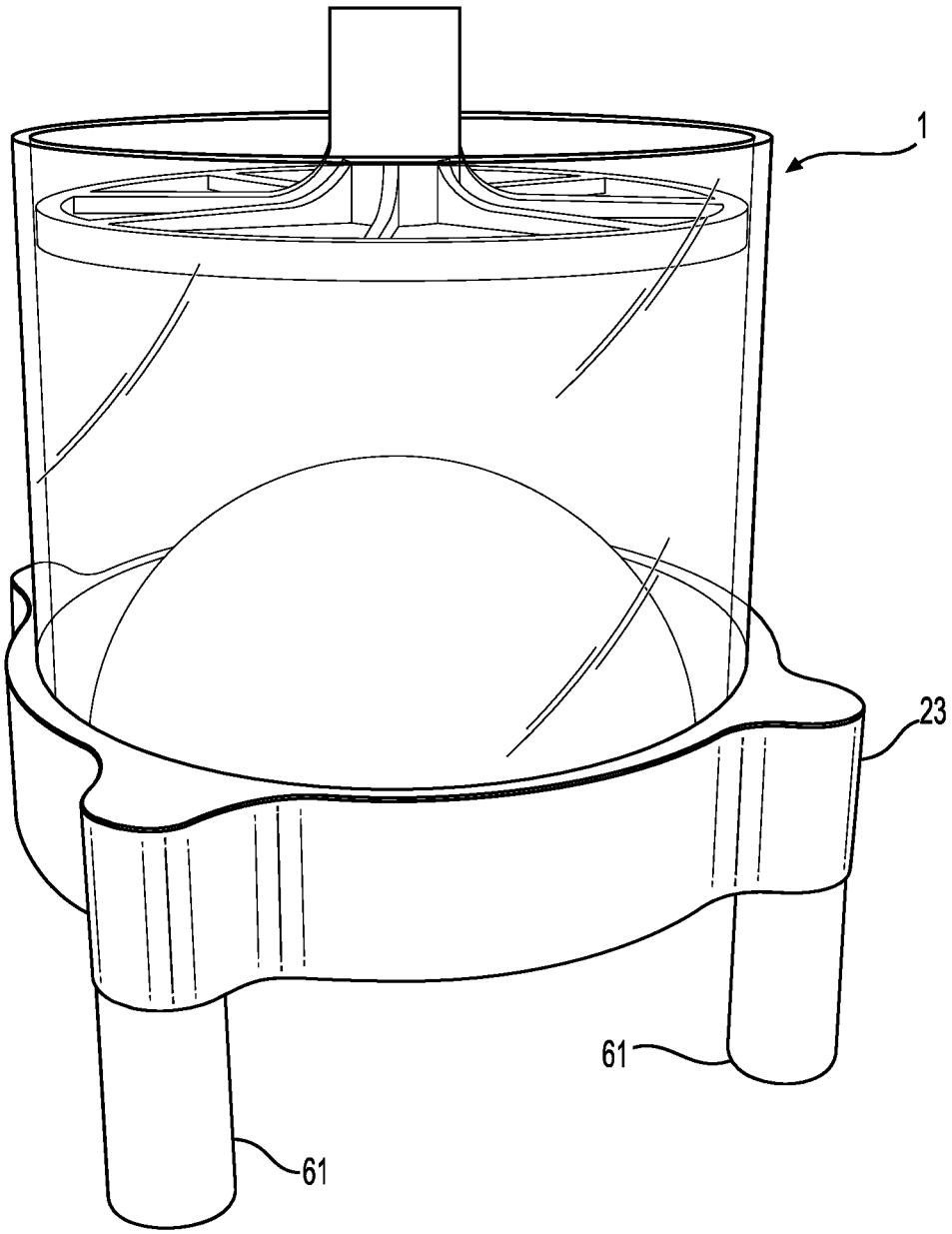
FIG. 6 shows an exterior side view of an exemplary explosive device with an alternative attachment mechanism.

FIG. 6. Shows an exemplary embodiment wherein an attachment collar 23 is a coupled to an adjustable stand-off bracket system 61 that allows the user to adjust the distance between the penetrator and the target surface. The stand-off bracket system can comprise an attachment coupled to a sliding rail such that the user can lift or lower the penetrator along the length of the charge container by rotating a knob. The knob can be coupled to a gear system and rail. The knob may be coupled either to the external surface of the attachment collar or external surface of the charge container.

Figure 7:
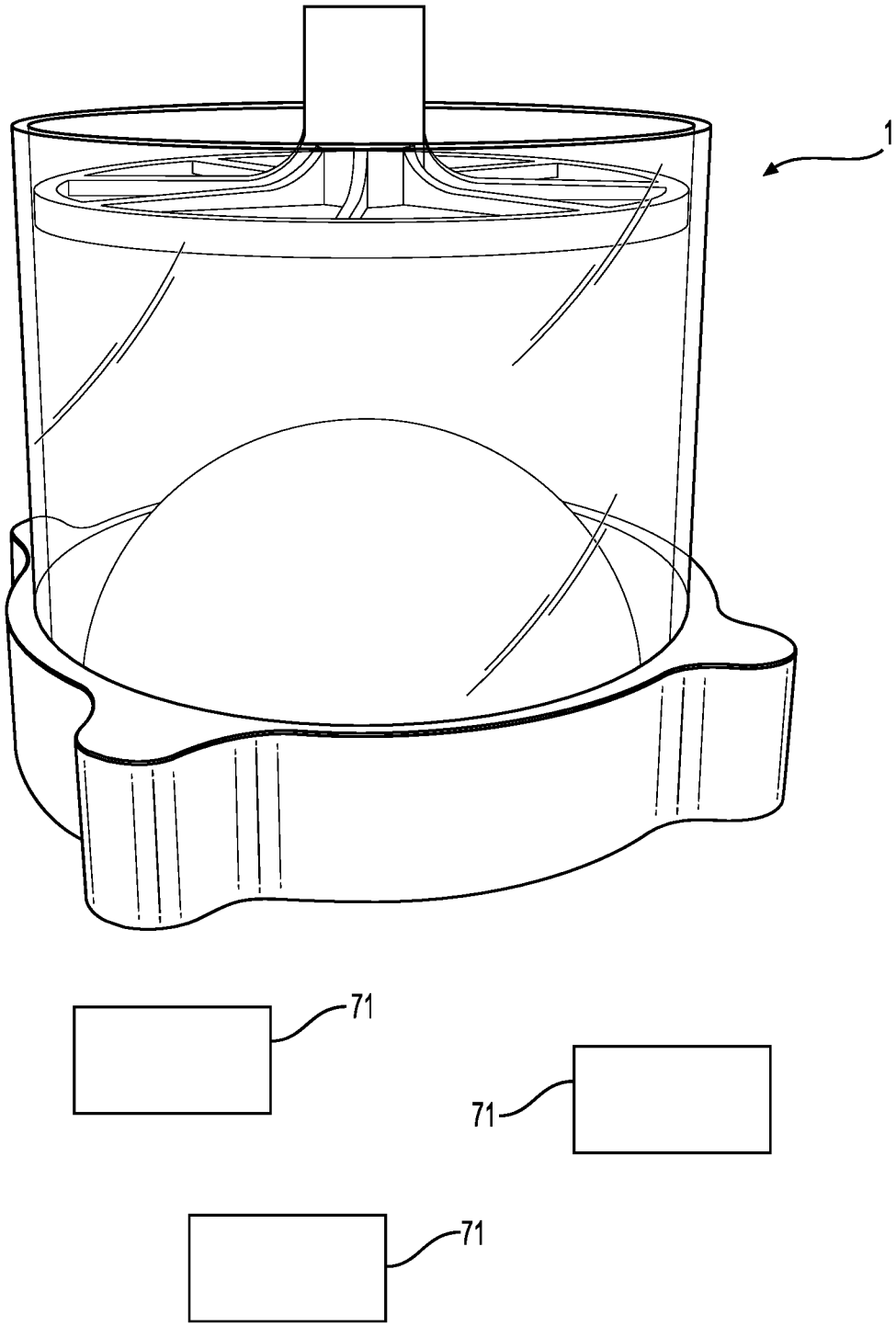
FIG. 7 shows an exterior side view of an exemplary explosive device with an alternative attachment mechanism.

FIG. 7 shows an exemplary embodiment wherein at least one disposable ferromagnetic attachment 71 can be coupled to a target surface using adhesives or mechanical couplers to convert a target surface to a ferromagnetic surface. The ferromagnetic attachments 71 to the target surface can be of a thickness that will not interfere with the breaching of the target surface by this embodiment of the explosive device.

Figure 8:
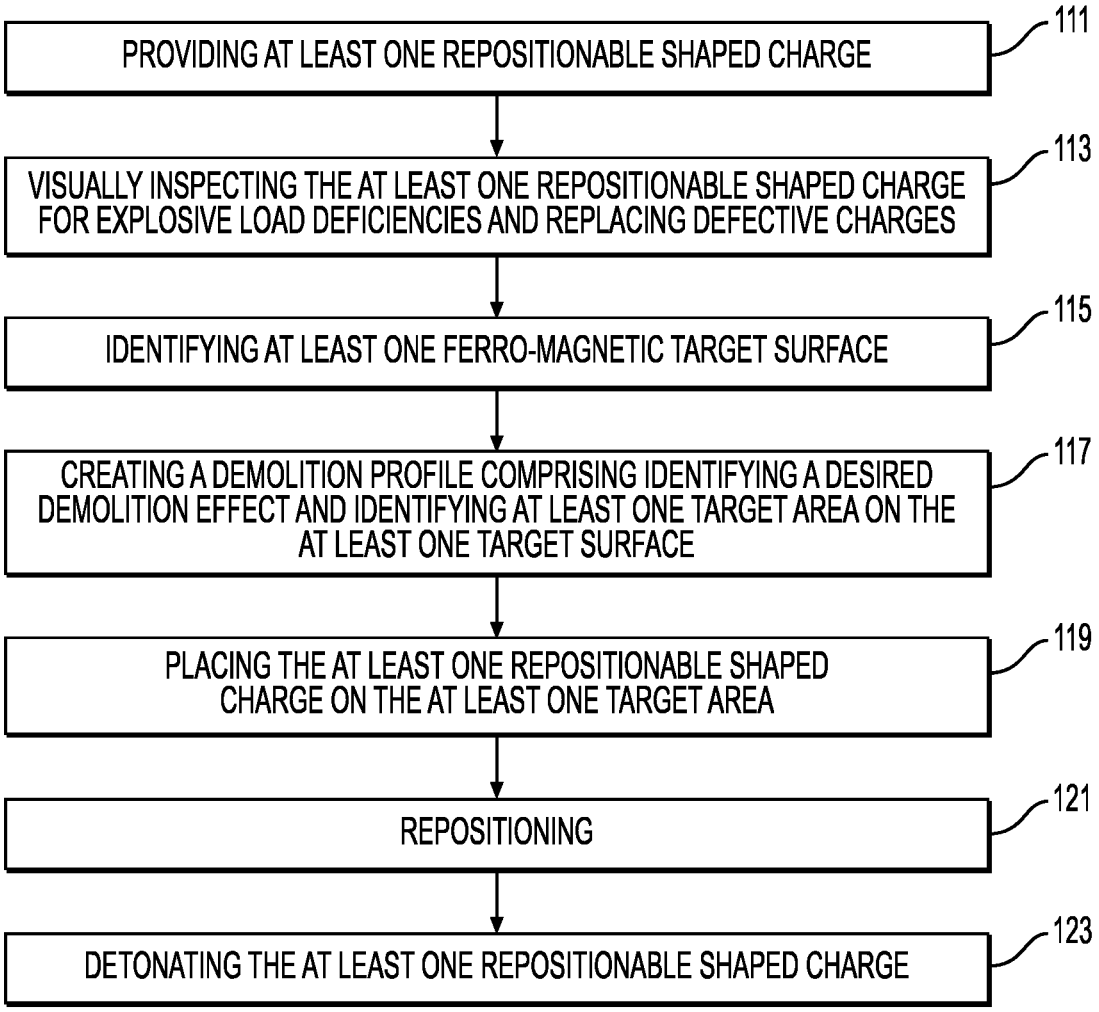
FIG. 8 shows an exemplary method for using at least one exemplary explosive device in a controlled detonation.

FIG. 8 shows an exemplary method of using at least one exemplary explosive device to penetrate a target structure. At step 111, providing at least one repositionable shaped charge. At step 113, Visually inspecting the at least one repositionable shaped charge for explosive load deficiencies and replacing defective charges. At step 115, Identifying at least one ferromagnetic target surface. At step 117, Creating a demolition profile comprising identifying a desired demolition effect and identifying at least one target area on the at least one target surface. At step 119, Placing the at least one repositionable shaped charge on the at least one target area. At step 121, Repositioning. Charges can be rapidly moved around and easily attached/detached from the target surface to meet the desired effect of the demolition profile. At step 123, Detonating the at least one repositionable shaped charge.

Although the invention has been described in detail with reference to certain preferred embodiments, variations and modifications exist within the spirit and scope of the invention as described and defined in the following claims.

The invention claimed is:

1. An explosive device comprising:

a charge container forming a body cavity;

an attachment collar forming a plurality of cavities and plurality of apertures, wherein each aperture of the plurality of apertures opens into a respective cavity of the plurality of cavities, wherein the attachment collar comprises a bottom face and is coupled to a first end of said charge container, said attachment collar further comprising a stand-off bracket system comprised of a knob, gear system and rail wherein said stand-off bracket system is coupled to said attachment collar of said explosive device allowing said penetrator to be raised and lowered within said charge container such that the distance between said penetrator and a target surface is adjustable;

an explosive load wherein the explosive load is inserted into said body cavity;

a wave shaper wherein said waver shaper is disposed within said body cavity;

a booster explosive wherein said booster explosive is disposed within said body cavity;

a charge top forming a first holding cavity and having a first aperture wherein said charge top is removably placed inside said charge container;

an initiator holder disposed within said charge top aperture forming a second holding cavity, wherein the initiator holder is removably placed within the first holding cavity;

a penetrator comprising a semi-spherical body comprising an exterior surface, an interior surface, and base rim, wherein the interior surface forms a penetrator cavity within said semi-spherical body and an aperture between the penetrator cavity and exterior of the penetrator; and a plurality of connectors, where each connector is disposed within a respective attachment collar cavity of the plurality of attachment collar cavities such that a bottom face of each connector is even with the bottom face of the attachment collar.

2. An explosive device of claim 1 wherein said charge container is comprised of a clear plastic material.

3. An explosive device of claim 1 wherein said connectors are magnets.

4. An explosive device of claim 1 wherein said connectors are adhesives.

5. An explosive device of claim 1 wherein said connectors are mechanical attachments.

6. An explosive device of claim 1 wherein said charge top is placed into said charge container by friction.

7. An explosive device of claim 1 wherein said charge top is placed into said charge container by a twist lock comprising a plurality of L-shaped notches in which said charge top locks into place.

8. An explosive device of claim 1 wherein said charge top is placed into said charge container by a container cap.

9. An explosive device of claim 1 further comprising a plurality of magnets attached to and projecting from said attachment collar by a ball and socket connection allowing the magnets to swivel in the direction of a ferromagnetic surface.

10. An explosive device of claim 1 wherein said connectors are configured to be interchangeably coupled to said plurality of cavities in said attachment collar.

11. An explosive device of claim 1 further comprising disposable ferromagnetic attachments that allow a target surface to be converted to a ferromagnetic surface wherein said disposable ferromagnetic attachments are coupled to a target surface by adhesive or mechanical couplers.

12. A method of demolishing a target comprising providing at least one explosive device comprising:

a charge container forming a body cavity;

an attachment collar forming a plurality of cavities and plurality of apertures, wherein each aperture of the plurality of apertures opens into a respective cavity of the plurality of cavities, wherein the attachment collar comprises a bottom face, said attachment collar further comprising a stand-off bracket system comprised of a knob, gear system and rail wherein said stand-off bracket system is coupled to said attachment collar of said explosive device allowing said penetrator to be raised and lowered within said charge container such that the distance between said penetrator and a target surface is adjustable;

an explosive load wherein the explosive load is inserted into said body cavity;

a wave shaper wherein said waver shaper is disposed within said body cavity;

a booster explosive wherein said booster explosive is disposed within said body cavity;

a charge top forming a first holding cavity and having a first aperture wherein said charge top is removably placed inside said charge container;

an initiator holder disposed within said charge top aperture forming a second holding cavity, wherein the initiator holder is removably placed within the first holding cavity;

a penetrator comprising a semi-spherical body comprising an exterior surface, an interior surface, and base rim, wherein the interior surface forms a penetrator cavity within said semi-spherical body and an aperture between the penetrator cavity and exterior of the penetrator; and a plurality of connectors, where each connector is disposed within a respective attachment collar cavity of the plurality of attachment collar cavities such that a bottom face of each connector is even with the bottom face of the attachment collar;

visually inspecting the at least one repositionable shaped charge for explosive load deficiencies and replacing defective charges;

identifying at least one target surface;

creating a demolition profile comprising identifying a desired demolition effect and identifying at least one target area on the at least one target surface;

placing the at least one repositionable shaped charge on the at least one target area repositioning the at least one shaped charge; and detonating the at least one repositionable shaped charge.

* * * * *